US005452638A

United States Patent [19]

Yancy

[11] Patent Number: 5,452,638

[45] Date of Patent: Sep. 26, 1995

[54] MULTIPLE TONE WIND CHIME

[76] Inventor: Bill Yancy, 3741 Seabrook Isl. Rd., Johns Island, S.C. 29455

[21] Appl. No.: 270,762

[22] Filed: Jul. 5, 1994

[51] Int. Cl.[6] ..... G10D 13/08

[52] U.S. Cl. ..... 84/404; 116/141; D10/116

[58] Field of Search ..... 84/402, 404; 116/141, 116/169; D17/22, 99; 446/418; D10/116, 119; D11/141

[56] References Cited

U.S. PATENT DOCUMENTS

| | | | |
|---|---|---|---|
| D. 272,810 | 2/1984 | Stilson | D11/141 |
| 864,461 | 8/1907 | Gibbs | 84/404 |
| 2,296,000 | 9/1942 | Ojalvo | 84/404 |
| 4,686,878 | 8/1987 | Herbert | 84/404 |
| 4,854,214 | 8/1989 | Lowe | 84/404 |
| 4,967,633 | 11/1990 | Jewell, Jr. | 84/404 |
| 5,072,208 | 12/1991 | Christensen | 116/141 |

OTHER PUBLICATIONS

Armchair Shopper, Feb. 1994, p. 36.

*Primary Examiner*—Michael L. Gellner
*Assistant Examiner*—Cassandra Spyrou
*Attorney, Agent, or Firm*—B. Craig Killough

[57] ABSTRACT

A wind chime having a striker which is comprised of multiple materials, each of which produces a different tone as the striker strikes the individual chimes of the wind chime.

12 Claims, 2 Drawing Sheets

MULTIPLE TONE WIND CHIME

FIELD OF THE INVENTION

This invention relates to wind chimes.

BACKGROUND OF THE INVENTION

Wind chimes are devices which are hung or suspended, usually outdoors, and which produce musical tones as the device is moved about by the wind. Generally, a striker is connected to a clapper, and as the clapper is moved about by the wind, it causes the striker to be blown into and against chimes, producing musical tones.

Wind chimes are characterized by a frame which is hung or suspended so that movement of the wind chime is not impeded by other objects. A plurality of chimes, usually four or more, are suspended from the frame. Most commonly, the chimes are hollow metallic tubes which are suspended vertically from the frame in a manner which allows movement of the tubes relative to the frame and relative to each other.

The plurality of tubes forms a boundary as determined by their position of suspension from the frame. Generally, the hollow tubes are suspended equidistant from each other, so that, for example, if four tubes are used, the four tubes form the boundary of a square, while five tubes form the boundary of a pentagon, and so on. The chimes are capable of movement relative to each other, with little or no interference in the movement of the chimes caused by the remaining chimes. The striker is suspended, such as from the frame or from the hanging means of the wind chime, and is present within the interior of the boundary formed by the wind tubes, generally in the center of the boundary. The striker is allowed to swing freely so as to strike the plurality of chimes.

The movement of the striker to strike the chimes is influenced by the clapper. The clapper is generally a disk or similar plane which is suspended horizontally to result in maximum exposure to the wind. As the wind contacts and pushes the clapper about, the striker is moved so as to strike the chimes to produce musical tones. The clapper may be decorative in shape or appearance.

The device is enhanced by the production of multiple tones. Various wind chimes are known in the art which use hollow tubes of varying dimensions form chimes which produce varying tones. The length or diameter of a hollow tube will affect the musical tone produced, and produce multiple tones.

The hollow tubes which form the chimes are allowed freedom of movement by means of their vertical suspension. This freedom of movement may result in the chimes becoming blown about in an undesired manner, and becoming entangled.

SUMMARY OF THE PRESENT INVENTION

The present invention is a striker which is comprised of at least two different materials which are present on the exterior surface of the striker. It is preferred that at least one of the materials is metallic, while at least one of the materials is non-metallic. For example, a non-metallic disk may have metallic members extending therefrom, so that differing tones are produced when the striker contacts a chime with a non-metallic surface, and a differing tone is produced when the striker strikes the chime at its metallic surface. Further, differing tones are produced when a combination of the metal surface of the striker and the non-metallic surface of the striker contact a single tube virtually simultaneously. A ring may extend from the striker through which the vertical chime may be placed. In this way, the chime produces differing tones depending on whether it is struck by the metallic surface, the non-metallic surface, or both. The ring retains the chimes to keep the chimes from being blown about in an undesired manner.

The use of the striker of the present invention provides multiple tones by means of the multiple composition of the striker. When combined with a plurality of the chimes at differing dimensions, a wide range of tones is produced by the wind chime. The invention may also provide a means to retain the wind chimes by means of the construction of the striker.

DETAILED DESCRIPTION OF THE PREFERRED EMBODIMENT

Figure 1:
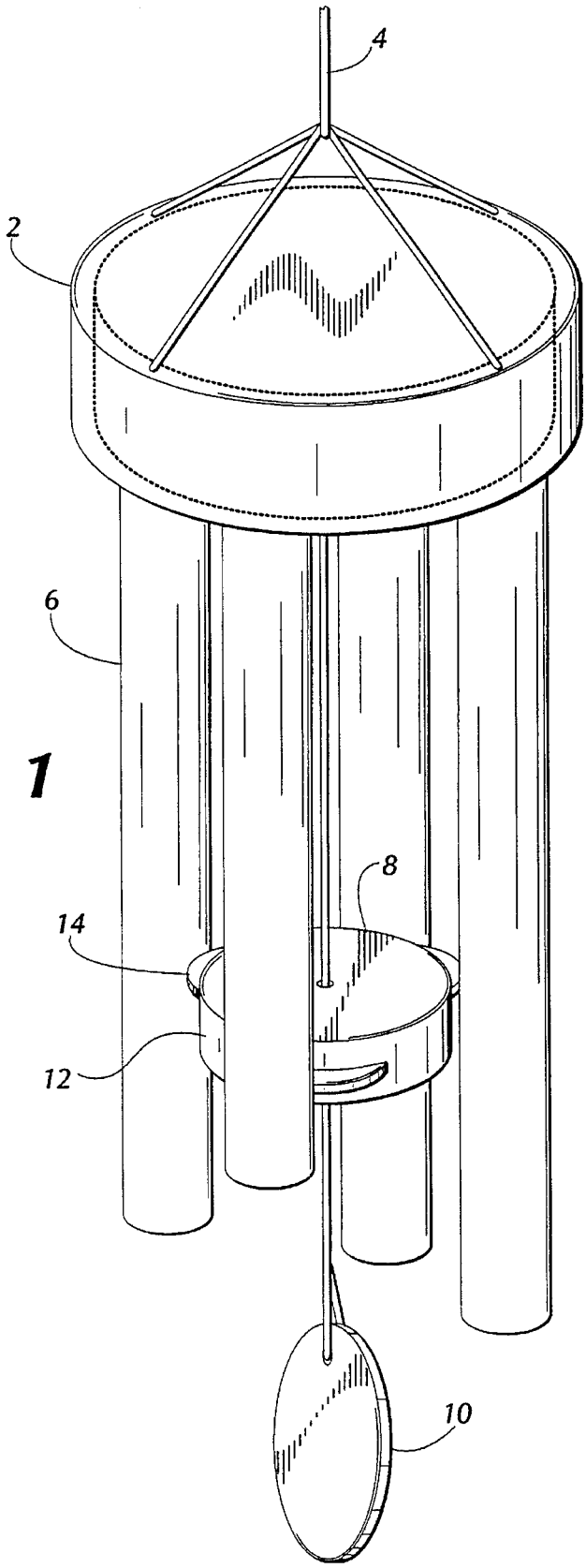
FIG. 1 is a perspective view of a wind chime incorporating one embodiment of the striker.

Referring now to the drawing figures, FIG. 1 shows a wind chime. A frame 2 is suspended by means of a line 4. The line can be a string, rope, chain, rod or other similar flexible member from which objects are commonly hung, and which will support the weight of the wind chime.

The frame 2 as shown in FIG. 1 is an inverted bowl. The use of an inverted bowl collects and directs sound from the chimes. The frame could be any structure which can be hung or suspended, and from which a plurality of chimes may be hung or suspended.

As shown in FIG. 1, four chimes 6 are incorporated. Any number of chimes could be used, however, it is unusual to use fewer than three chimes, or more than six chimes.

Most commonly, the chimes are fabricated from hollow, metallic tubing. Tubing of the desired diameter is cut to the desired length. The metal tube which forms the chimes could be aluminum, copper, steel or other metal, or the tube could be fabricated from other materials which will produce a tone when struck by a striker. As shown in FIG. 1, the hollow tubes are cut to different lengths to form chimes having different tone characteristics.

Chimes are suspended from the frame. Chimes are suspended in a manner so that the chimes are allowed some freedom of movement relative to the frame. The use of the inverted bowl shaped frame shown in FIG. 1 not only collects and directs the sound, it also retains and limits movement of the chimes.

The tone of the wind chime is produced by the striker 8 striking the chimes. As the wind chime is exposed to the wind, the wind moves the chimes about so as to strike the striker, but more importantly, the striker is moved about by the wind so as to strike the chimes. The swinging motion of the wind chime, the individual chime members, and the striker, produces sound from the wind chime. The striker strikes the chimes and rebounds to strike other chimes.

Movement of the striker is influenced by the clapper 10. Most commonly, the clapper is a plane which is suspended horizontally for maximum exposure to the wind. The wind strikes the clapper, and as the clapper is moved about, it causes the striker to move about to strike the wind chimes, due to the communication between the clapper and the striker.

The striker is suspended within the boundary formed by the position of the chimes on the frame. Most commonly, the chimes will be positioned equidistantly about the frame, so that as shown in FIG. 1, the four tubes form the corners of an imaginary square. The striker is within this boundary, and most commonly, is located at about the center of the boundary so formed. More than one striker may be used.

The striker is suspended to allow substantial movement of the striker. Most commonly, a line, string, or similar flexible member hangs vertically, with the striker suspended therefrom. The striker could be suspended from the frame, or suspended from the line on which the wind chime is suspended.

The clapper is suspended so as to be positioned underneath the striker. The clapper is connected by a line, which is usually, although not necessarily, flexible to allow the clapper to extend below the bottom of the chimes in the preferred structure. By suspending the clapper below the bottom of the chimes, maximum exposure to the wind is achieved.

The striker of the present invention is comprised of at least two different materials. Each of these materials is present on an exterior surface of the striker, so that the chimes are exposed to different materials. As one or the other of the different materials of the striker strikes the chime, a different tone is produced from the same chime.

As shown in FIG. 1, the striker 8 is a round disk 12 which is positioned horizontally within the interior boundary formed by the chimes. Other configurations or shapes for the disk could be used. In the preferred embodiment, the disk will be comprised of a non-metallic material, such as a ceramic or wooden material, which has sufficient hardness to produce a tone from the chime when the non-metallic material strikes the chime, which is generally made of metal. A plurality of metallic members extends from the non-metallic disk. Generally, the metallic members will extend horizontally from a surface, such as a side, of the striker. As the striker moves, the striker may contact a chime on a surface of the striker which is non-metallic, producing a tone, or on a surface which is metallic, producing a differing tone, or perhaps generally simultaneously, producing varying tones.

Various configurations of the striker can be used. The surface of the striker should have varying material characteristics, with at least two different materials present on various portions of the surface of the striker.

Figure 2:
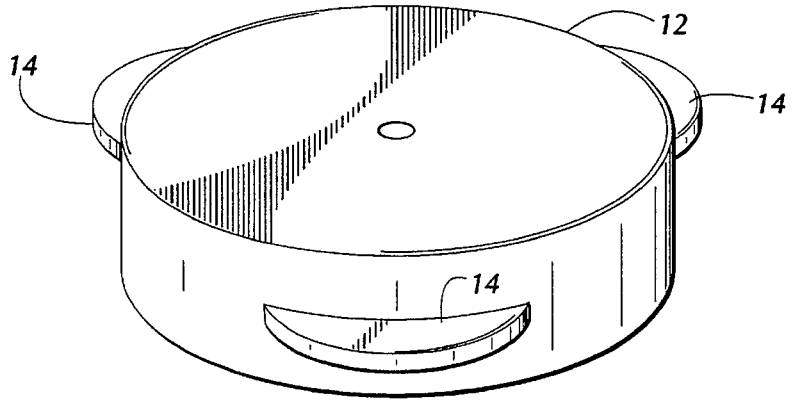
FIG. 2 is an enlarged isolation of the striker shown in FIG. 1.

FIG. 2 shows the embodiment of the striker which is incorporated in the wind chime of FIG. 1. This embodiment is a disk 12 having a plurality of members 14 extending horizontally therefrom, each having an arcuate shape, with an arcuate surface which strikes the chimes. In the preferred embodiment, the disk is comprised of a relatively hard non-metallic material, with the members extending from the disk being comprised of a metal, such as stainless steel or aluminum.

The members extending from the disk could have a different structure from that shown in FIG. 2. It is preferred that the members extend generally perpendicularly to the vertical chimes, so that the chimes may contact either the member or the disk of the striker, without trapping or hindering the movement of the chime against the striker, and without hindering the rebounding of the striker. The structure of the embodiment shown in FIG. 3 also achieves these desired functional qualities.

Figure 3:
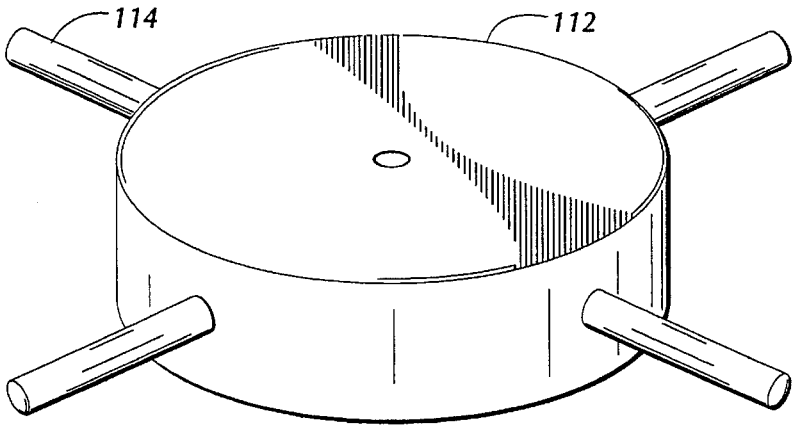
FIG. 3 is a second embodiment of the striker.

An additional embodiment of the striker is shown in FIG. 3. Again, a disk 112 is used having a plurality of members 114 extending from the disk. The members extend generally horizontally from the disk, or perpendicular to the tubes which comprise the chimes. The members may be rods or tubes. In the preferred embodiment, the disk is a relatively hard non-metallic material, such as ceramic, wood, hard rubber, or other material, while the members are metallic, such as stainless steel or aluminum.

Figure 4:
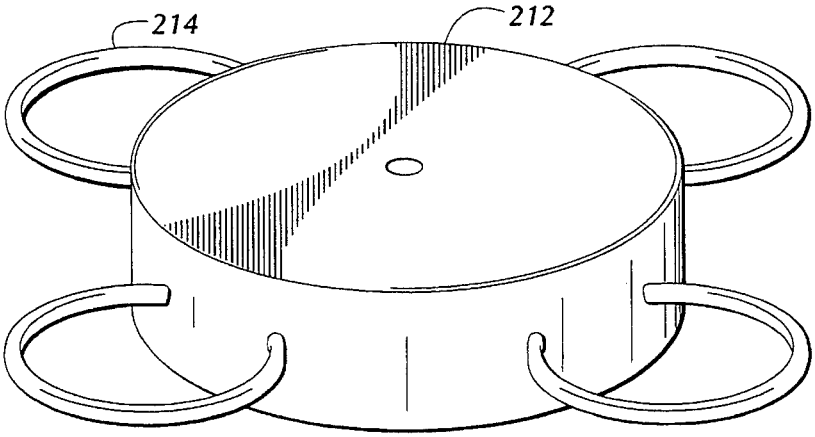
FIG. 4 is a third embodiment of the striker showing retaining rings through which the chimes may be placed.

FIG. 4 shows yet another embodiment of the device. A disk 212 which is similar in structure to the disk of FIGS. 2 and 3 is presented, with a plurality of rings 214 extending from the side of the disk in a generally horizontal manner, or perpendicularly to the vertical tubes which form the chimes. In the preferred embodiment, again, the disk is a relatively hard non-metallic material, while the rings are metallic.

The embodiment shown in FIG. 4 allows a chime to strike the two different surface materials, such as the non-metallic material of the disk, and the metallic material of the ring. As with the other embodiments, the disk could be formed of more than one material, and the members could be formed of differing materials as well. For example, in FIG. 4, the rings could be of different metals to produce different tones, or the rings could be of differing dimensions to produce different tones. The rings allow the chimes to move within the rings to strike the differing surface materials, without trapping and holding the hollow tube. The rings, while allowing freedom of movement within the rings, do limit the travel of the chimes. The chimes 6 are inserted through one or more of the rings, thereby limiting movement of the chimes. By limiting the movement of the chimes, damage to the wind chime apparatus is reduced in the event of high velocity wind situations. Further, the individual chimes will not become tangled about each other. The rings may extend generally horizontally from the disk toward the chimes. At least one of the chimes is positioned within an interior void of at least one of the rings, so that the ring forms a boundary around the chime.

What is claimed is:

1. A multiple tone wind chime, comprising:

a. a frame;

b. a plurality of chimes which are suspended vertically from said frame and which are spaced apart and arranged to allow movement of said chimes; and c. at least one striker which is suspended from above and positioned within an inner boundary formed by said chimes, wherein said striker is comprised of a disk having a surface formed about the perimeter of said disk which strikes said chimes, wherein said surface is adjacent to said inner boundary formed by said chimes, and said surface has at least one area which is comprised of a first material which strikes said chimes and at least one additional area which is comprised of a second material which strikes said chimes, wherein said first material and said second material are different materials.

2. A multiple tone wind chime as described in claim 1, wherein said first material is non metallic, and said second material is metallic.

3. A multiple tone wind chime, comprising:

a. a frame;

b. a plurality of chimes which are suspended vertically from said frame and which are spaced apart and arranged to allow movement of said chimes; and c. at least one striker which is suspended from above and positioned within an inner boundary formed by said chimes, wherein said striker is a disk which is comprised of a first material, said disk having at least one member extending from an exterior surface of said disk which is comprised of a second material.

4. A multiple tone wind chime as described in claim 3, wherein said at least one member are of an arcuate shape and extend generally horizontally from said disk toward said chimes.

5. A multiple tone wind chime as described in claim 3, wherein said at least one member are rods which extend generally horizontally from said disk toward said chimes.

6. A multiple tone wind chime as described in claim 3, wherein said at least one member are tubes which extend generally horizontally from said disk toward said chimes.

7. A multiple tone wind chime as described in claim 3, wherein said at least one member are rings which extend generally horizontally from said disk toward said chimes, wherein said rings have an aperture therein, and wherein at least one of said chimes is positioned within said aperture of one of said rings so that said ring forms a boundary around said chime.

8. A multiple tone wind chime as described in claim 3, wherein said first material is non metallic, and said second material is metallic.

9. A multiple tone wind chime as described in claim 4, wherein said first material is non metallic, and said second material is metallic.

10. A multiple tone wind chime as described in claim 5, wherein said first material is non metallic, and said second material is metallic.

11. A multiple tone wind chime as described in claim 6, wherein said first material is non metallic, and said second material is metallic.

12. A multiple tone wind chime as described in claim 7, wherein said first material is non metallic, and said second material is metallic.

* * * * *